US009295342B2

(12) United States Patent
Ferraro et al.

(10) Patent No.: US 9,295,342 B2
(45) Date of Patent: Mar. 29, 2016

(54) HEIGHT ADJUSTOR FOR INFANT SWING UNIT

(71) Applicant: Dorel Juvenile Group, Inc., Foxboro, MA (US)

(72) Inventors: Allan R Ferraro, Attleboro, MA (US); Ward A Fritz, Westwood, MA (US); Brian C Sundberg, Chester, NH (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 14/635,349

(22) Filed: Mar. 2, 2015

(65) Prior Publication Data

US 2015/0265068 A1 Sep. 24, 2015

Related U.S. Application Data

(60) Provisional application No. 61/968,176, filed on Mar. 20, 2014.

(51) Int. Cl.

| | |
|---|---|
| ***A63G 9/00*** | (2006.01) |
| ***A47D 13/10*** | (2006.01) |
| ***A47D 1/00*** | (2006.01) |

(52) U.S. Cl.

CPC ..... *A47D 13/105* (2013.01); *A47D 1/004* (2013.01); *A63G 9/00* (2013.01)

(58) Field of Classification Search

CPC ..... A47D 13/00; A47D 13/105; A63G 9/00; A63G 9/12; A63G 9/14; A63G 9/16

USPC ..... 472/118–125; 297/273, 274; 482/69, 482/75, 77, 78, 143

See application file for complete search history.

(56) References Cited

U.S. PATENT DOCUMENTS

| | | | | |
|---|---|---|---|---|
| 4,940,229 | A * | 7/1990 | Foster | A47D 13/105 297/276 |
| 5,562,548 | A | 10/1996 | Pinch et al. | |
| 6,421,901 | B2 * | 7/2002 | Sitarski | A47D 13/00 29/401.1 |
| 6,500,072 | B1 | 12/2002 | Myers et al. | |
| 8,070,617 | B2 * | 12/2011 | Barron | A47D 13/105 472/118 |
| 8,900,063 | B2 * | 12/2014 | Lin | A47D 13/105 472/119 |
| 2014/0018179 | A1 * | 1/2014 | Mountz | A47D 13/105 472/119 |

OTHER PUBLICATIONS

"Fisher-Price X7340 Swing Assembly Guide," 2013, 24 pages.

* cited by examiner

*Primary Examiner* — Kien Nguyen
(74) *Attorney, Agent, or Firm* — Barnes & Thornburg LLP

(57) ABSTRACT

A juvenile swing includes a foundation adapted to set on a floor, a swing, and a swing support coupled to the foundation and the swing. The swing is arranged to swing about a swing axis relative to the swing support.

13 Claims, 9 Drawing Sheets

30
441
SEE FIG. 8B
443
40
435G
14
42
142
141

30
423
442
424S
441
424
F
443
434A
434T
30L
425
140
42
MOVABLE POST-SUPPORT TUBE
435T
435
435G
LOWERED LATCH-RETRACTING POSITION
40
141
431
434B
FIRST RETRACTOR LATCH EXTENDED
142
432
SECOND RETRACTOR LATCH EXTENDED
434

443

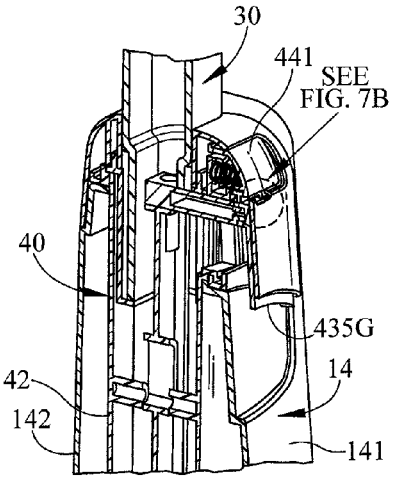
FIG. 9A
FIG. 9B
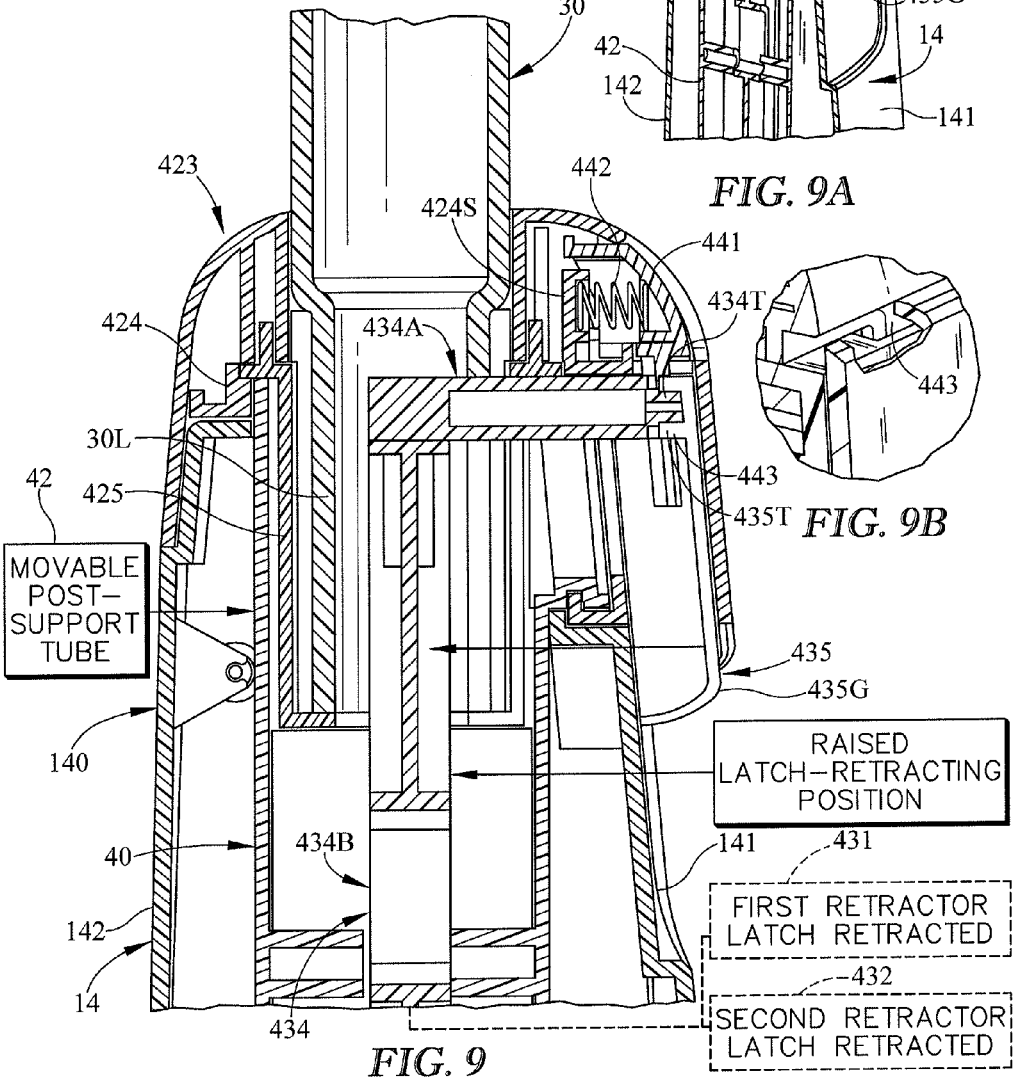
FIG. 9

THIRD LATCH RECEIVER
103
SECOND LATCH RECEIVER
102
FIRST LATCH RECEIVER
101
FOURTH LATCH RECEIVER
104
30
423
424
40
420
42
143
141
14
142

HEIGHT ADJUSTOR FOR INFANT SWING UNIT

PRIORITY CLAIM

This application claims priority under 35 U.S.C. §119(e) to U.S. Provisional Application Ser. No. 61/968,176, filed Mar. 20, 2014, which is expressly incorporated by reference herein.

BACKGROUND

The present disclosure relates generally to swings. More particularly, the present disclosure relates to a height-adjustable swing for an infant.

SUMMARY

An infant swing unit in accordance with the present disclosure includes a foundation adapted to set on a floor and a swing adapted to support an infant or other juvenile for swinging movement about a horizontal swing axis. The infant swing unit is configured to allow the height of the swing above the underlying floor to be varied by a caregiver.

In illustrative embodiments, the infant swing unit includes a variable-height swing carrier arranged to interconnect the foundation and the swing. The swing carrier includes an elevated swing mount coupled to a pivotable swing arm of the swing and an extensible post extending downwardly from the elevated swing mount to mate with an underlying post-height adjustor that is mounted for up-and-down movement in the stationary foundation. The post-height adjustor is operable by a caregiver to adjust the height of the extensible post so as to change the elevation of the swing.

In illustrative embodiments, the post-height adjustor is configured to provide means for supporting the extensible post for up-and-down movement relative to the stationary foundation and retaining the extensible post in more than one elevated position relative to the stationary foundation so that the height of the swing above the floor underlying the foundation can be varied by a caregiver. A lower end of the extensible post is supported on an upper end of the post-height adjustor. The post-height adjustor can be unlocked and then moved upwardly relative to the stationary foundation by a caregiver to raise the extensible post and move the swing mount and the swing coupled to the swing mount to a higher elevation above the floor. The post-height adjustor also can be unlocked and then moved downwardly by the caregiver to lower the extensible post and move the swing mount and the swing to a lower elevation closer to the floor.

In illustrative embodiments, the post-height adjustor comprises a movable post-support tube coupled to a lower end of the extensible post, a releasable tube anchor including a lift handle, and a lift handle lock. The movable post-support tube is configured to be moved by a caregiver upwardly and downwardly in a vertical channel formed in the stationary foundation to change the elevation of the extensible post, swing mount, and swing. The extensible post moves upwardly and downwardly with the movable post-support tube relative to the foundation since the lower end of the extensible post is coupled to an upper end of the movable post-support tube.

In illustrative embodiments, the releasable tube anchor includes a motion-blocker latch that can be extended laterally outwardly from the post-support tube into one of several latch receivers formed in the stationary foundation to retain the post-support tube in a fixed position relative to the stationary foundation so as to determine the elevation of the extensible post, swing mount, and swing relative to the stationary foundation and the underlying floor. To change the elevation of the swing, the caregiver first actuates the lift handle lock to unlock the normally locked lift handle included in the movable post-support tube. The caregiver can lift the lift handle upwardly when the lift handle is unlocked to cause a latch retractor coupled to the lift handle to retract the motion-blocker latch laterally inwardly into the post-support tube to disengage the latch receiver formed in the stationary foundation to free the post-support tube and its lift handle to be moved by the caregiver to a new higher or lower position in the vertical channel formed in the stationary foundation. The lift handle lock is configured normally to block lifting of the lift handle. However, the lift handle lock can be operated by the caregiver to unblock the lift handle so that the lift handle can be lifted and the post-support tube can be moved upwardly and downwardly in the vertical channel formed in the stationary foundation to change the elevation of the extensible post, swing mount, and swing.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 7A is a perspective view of the components shown in FIG. 7;

FIG. 7B is an enlarged view of the circled region of FIG. 7A (with a portion of the tube cap broken away) to show engagement of the laterally spaced-apart handle-motion stop tabs that extend downwardly from the spring-biased actuator button with underlying laterally spaced-apart tab flanges included in the lift handle to lock the lift handle and thereby block upward movement of the latch retractor relative to the movable post-support tube;

FIG. 9 is a view similar to FIGS. 7 and 8 showing that the caregiver applied a lifting force to the unlocked lift handle shown in FIG. 8 and then lifted the latch retractor to the raised latch-retracting position shown in FIG. 12 so that the post-height adjustor, extensible post, swing mount, and swing can be moved as a unit up and down relative to the stationary foundation to change the elevation of the swing above the underlying floor;

FIG. 9A is a perspective view of the components shown in FIG. 9;

FIG. 9B is an enlarged view of the circled region of FIG. 9A (with a portion of the tube cap broken away) to show that the laterally spaced-apart handle-motion stop tabs extend downwardly through to straddle a horizontally extending handle mount coupled to the top of the latch retractor;

DETAILED DESCRIPTION

Figure 1:
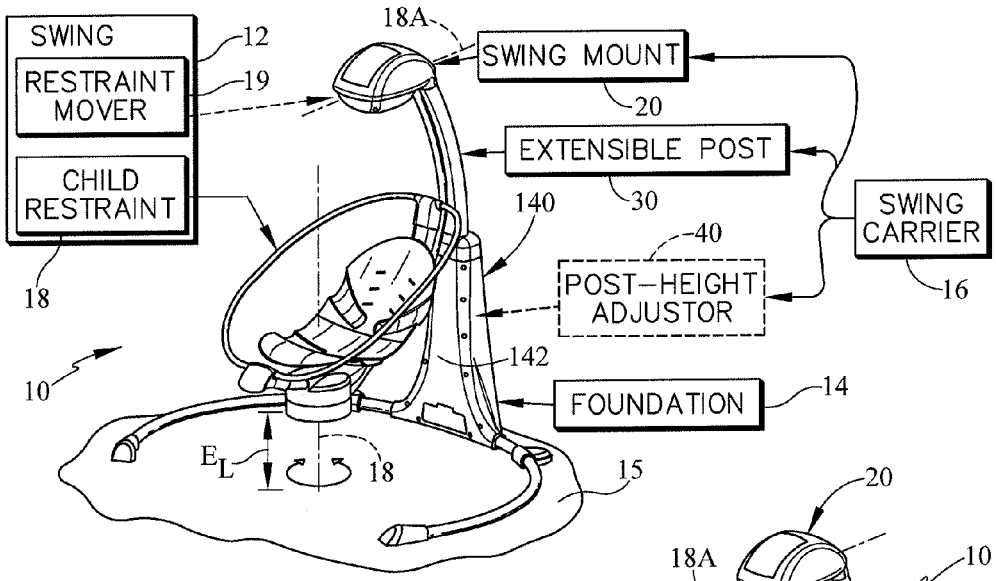
FIG. 1 is a perspective view of an infant swing unit in accordance with the present disclosure showing that a swing is adapted to support an infant for swinging motion about a horizontal swing axis and that a variable-height swing carrier is provided to interconnect a stationary foundation and the swing and position the swing in a lowest elevated position at a lowest elevation ($E_L$) above the underlying floor and suggesting that the swing carrier includes an elevated swing mount coupled to pivotable swing arms included in the swing, an extensible post arranged for up-and-down movement in the stationary foundation to raise and lower the swing mount and the swing relative to the underlying floor, and a caregiver-controlled post-height adjustor provided in the foundation and configured to support and move the extensible post in upward and downward directions in the foundation and to retain the extensible post in various raised and lowered positions to allow a caregiver to vary the height of the extensible post so as to change the elevation of the swing mount and the swing above the underlying floor.

An infant swing unit 10 includes a swing 12, a stationary foundation 14 adapted to set on a floor 15, and a variable-height swing carrier 16 mounted on foundation 14 and arranged to support swing 12 at various heights above floor 15 as suggested in FIG. 1. Swing carrier 16 can be operated by a caregiver as suggested in FIGS. 7-9 to raise swing 12 upwardly from an initial lowest elevated position shown in FIGS. 1, 10, and 11 first to a highest elevated position shown in FIGS. 2 and 13 and then to a first intermediate position shown in FIG. 3A.

Swing 12 includes a child restraint 18 configured in any suitable manner to support an infant (not shown) for swinging movement about a horizontal swing axis 12A as suggested in FIG. 1. In illustrative embodiments, swing 12 also includes a motorized restraint mover 19 coupled to child restraint 18 and configured to rotate child restraint about horizontal axis 18A at the option of a caregiver as suggested in FIG. 1. Restraint mover 19 is coupled to swing mount 20 to move therewith as suggested in FIGS. 1-3B.

Child restraint 18 of swing 12 includes a seat-support frame 18B, a seat 18C mounted on seat-support frame 18B to move therewith, and a swing arm 18D as shown, for example, in FIGS. 1-3B. A lower end of swing arm 18D is coupled to seat-support frame 18B and an upper end of swing arm 18D is coupled to restraint mover 19 to support seat-support frame 18B for swinging movement about horizontal axis 12A during operation of restraint mover 19. Child restraint 18 also includes in illustrative embodiments a rotatable base 18E coupled to seat-support fame 18B and to lower end of swing arm 18D to support frame 18B (and seat 18C) for rotation about a vertical axis 18A from a forward-facing position shown in FIGS. 1 and 2 to a side-facing position shown in FIGS. 3A and 3B.

Swing carrier 16 is coupled to stationary foundation 14 and to swing 12 and configured to support swing 12 in several elevated positions above floor 15 at the option of a caregiver (not shown) as suggested in FIGS. 1-3A. Swing carrier 16 includes a swing mount 20, an extensible post 30, and a caregiver-controlled post-height adjustor 40 as suggested in FIGS. 1 and 3B. Swing 12 is coupled to swing mount 20 in any suitable manner for swinging movement about horizontal swing axis 12A as suggested in FIG. 1. Extensible post 30 is arranged to mate with swing mount 20 and extend downwardly toward floor 15 to mate with the post-height adjustor 40 that is located in stationary foundation 14 to support swing mount 20 and swing 12 in elevated positions above floor 15. Post-height adjustor 40 is operable by a caregiver to raise or lower extensible post 30 relative to stationary foundation 14 to change the elevation of swing 12 above the underlying floor 15 as suggested in FIGS. 1-3B. Post-height adjustor 40 comprises several components shown diagrammatically in FIG. 3B and illustratively in FIG. 5.

Figure 3A:
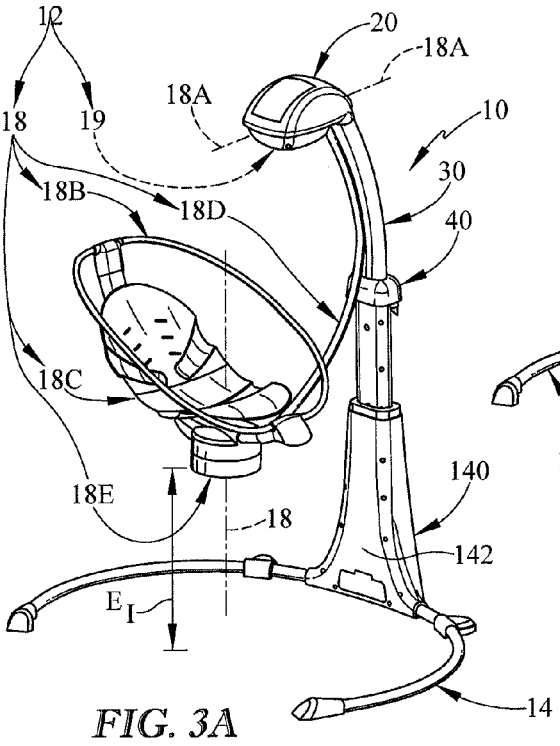
FIG. 3A is a view similar to FIGS. 1 and 2 showing that the swing is positioned to lie in one of two intermediate elevated positions at a first intermediate elevation ($E_I$) above the underlying floor.
Figure 3B:
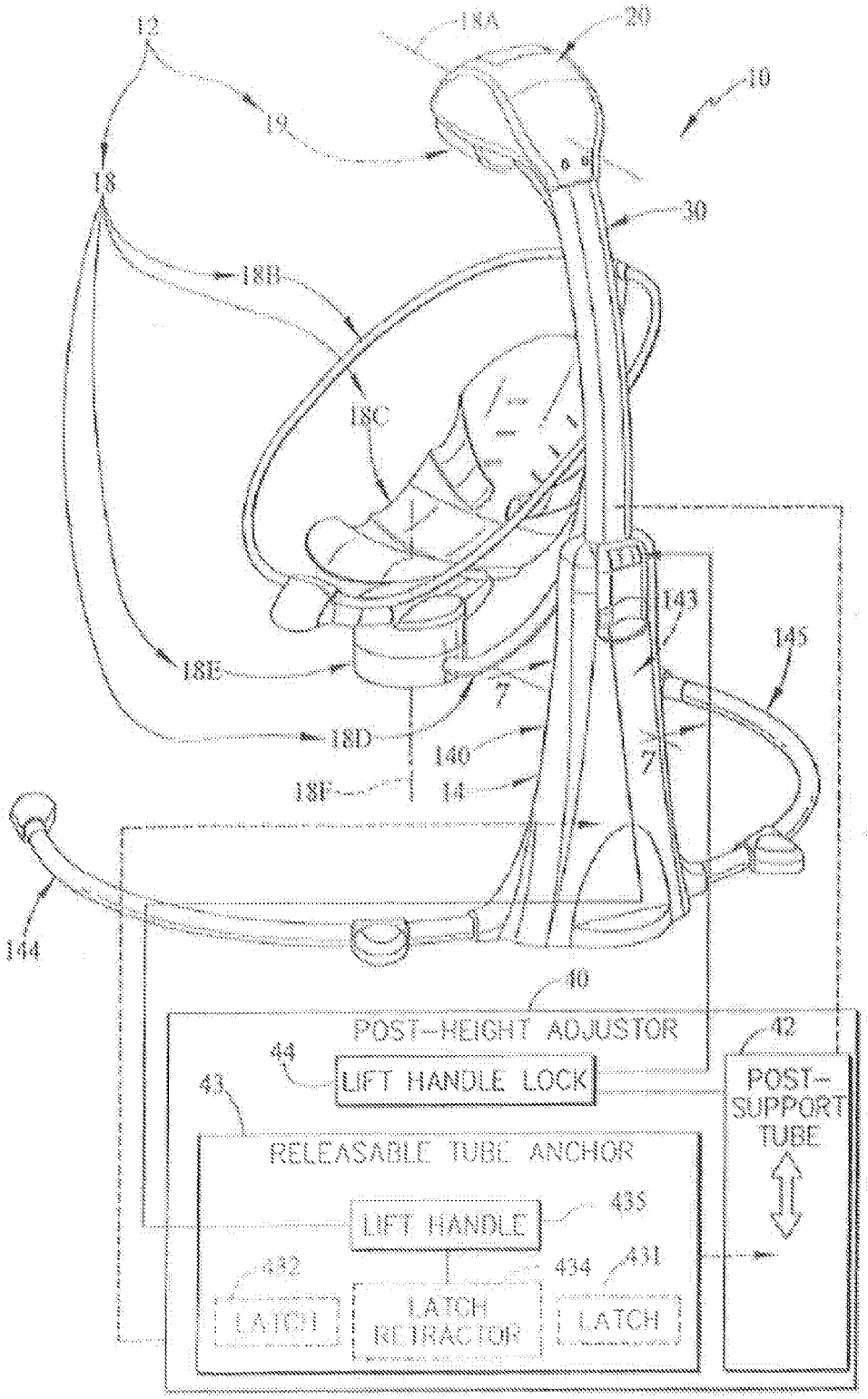
FIG. 3B is a rear perspective view of the infant swing unit of FIG. 3A suggesting that the post-height adjustor comprises (1) a post-support tube coupled to a lower end of the extensible post and mounted for up-and-down movement in a vertical channel formed in the stationary foundation, (2) a releasable tube anchor that includes a lift handle that is available to be operated by a caregiver, a pair of retractable post motion-blocker latches, and a latch retractor coupled to the lift handle and operable to move the motion-blocker latches relative to the post-support tube and to the stationary foundation from (1) extended positions (shown in FIGS. 10 and 11) wherein the latches engage companion latch receivers formed in the stationary foundation to block up-and-down movement of the post-height adjustor and the extensible post relative to the stationary foundation to (2) retracted positions (shown in FIG. 12) wherein the post-support tube and the extensible post are free to be moved by a caregiver in up-and-down directions relative to the stationary foundation to change the elevation of the swing mount and the swing relative to the underlying floor.
Figure 4:
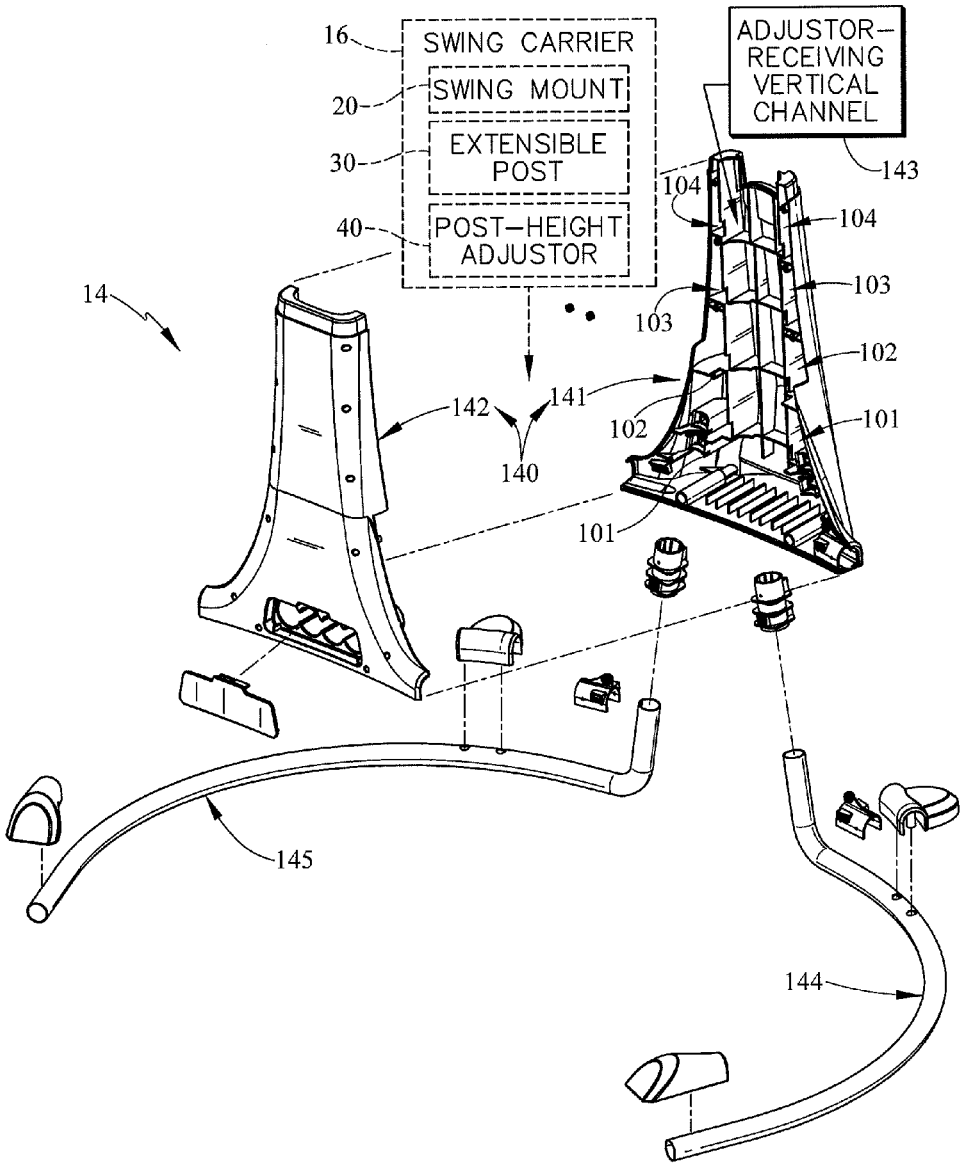
FIG. 4 is an exploded perspective assembly view of the stationary foundation of FIGS. 1-3 and showing that the stationary foundation includes a base comprising laterally spaced-apart upright first and second base shells, a curved first base stabilizer leg, and a curved second base stabilizer leg and suggesting that the post-height adjustor of the swing carrier (shown diagrammatically in phantom) is arranged to extend downwardly into an adjustor-receiving vertical channel formed in a space bounded by the first and second base shells of the stationary foundation as shown, for example, in FIGS. 7-13.

Stationary foundation 14 includes a base 140 comprising a first base shell 141 that mates with a companion second base shell 142 as suggested in FIG. 4 to define an adjustor-receiving vertical channel 143 therebetween. Post-height adjustor 40 is arranged to be moved up and down in vertical channel 143 relative to base 140 of stationary foundation 14 to change the elevation of extensible post 30 (and swing mount 20 and swing 12) as suggested in FIGS. 10-13 and 1-3A. In illustrative embodiments, stationary foundation 14 also includes curved first and second base stabilizer legs 144, 145 coupled to base 140 as suggested in FIGS. 1 and 4.

Post-height adjustor 40 includes a post-support tube 42, a releasable tube anchor 43 including a lift handle 444, and a lift handle lock 44 as suggested diagrammatically in FIG. 3B. An exploded perspective assembly view of an illustrative embodiment of post-height adjustor 40 is provided in FIG. 5.

Post-support tube 42 of post-height adjustor 40 is coupled to a lower end 30L of extensible post 30 and mounted for up-and-down movement n the vertical channel 143 formed in base 140 of stationary foundation 14 as suggested diagrammatically in FIG. 3B and illustratively in FIGS. 7 and 10-13. A lower portion 30L of extensible post 30 is coupled to an upper portion 42U of post-support tube 42 as suggested in FIG. 7 to cause extensible post 30 to move up or down in response to up or down movement of post-support tube 42U in the adjustor-receiving vertical channel 143 formed in base 140 of stationary foundation 14.

Figure 5:
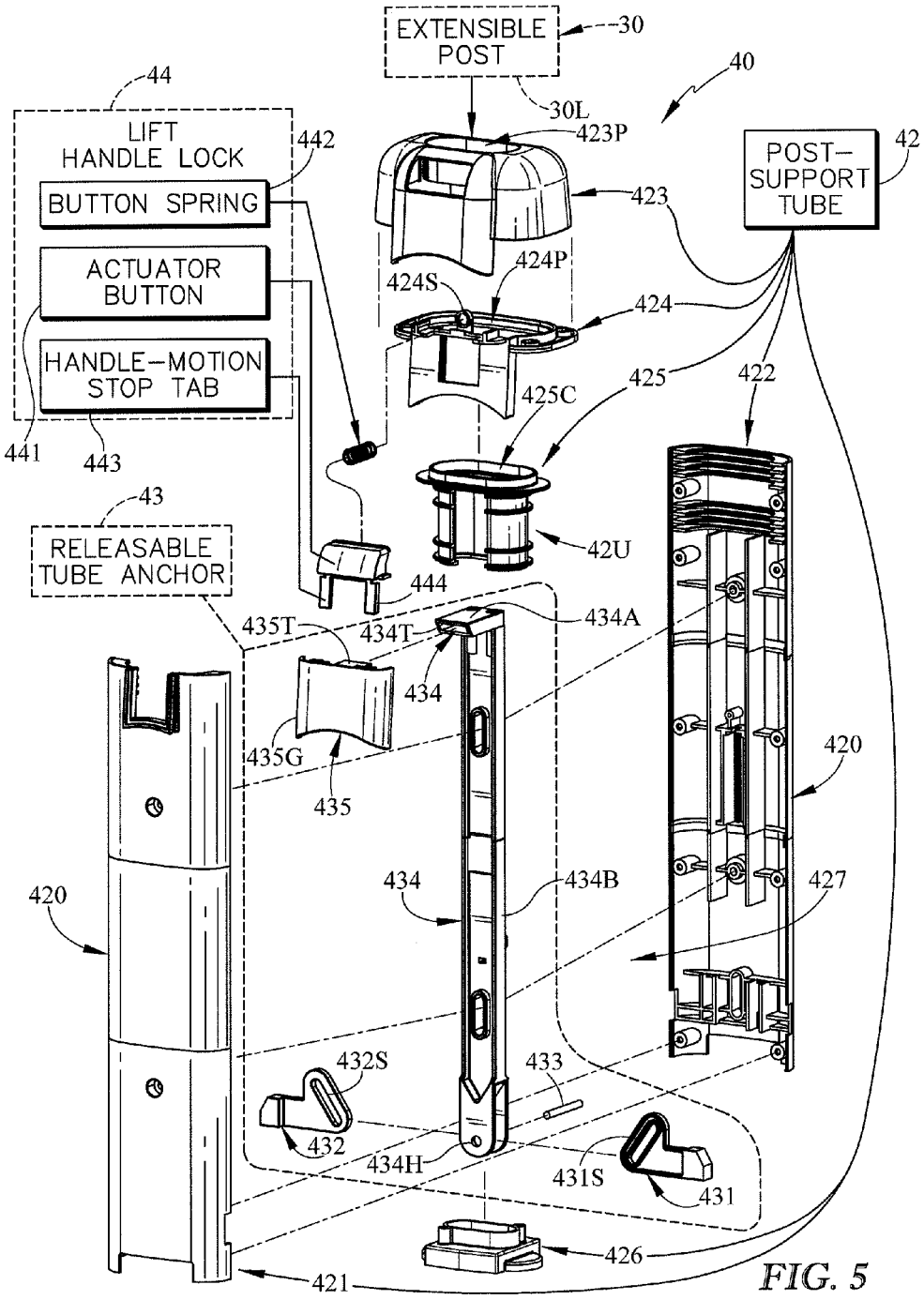
FIG. 5 is an exploded perspective assembly view of the post-height adjustor showing that the post-height adjustor includes: (1) a movable post-support tube including companion upright first and second tube shells arranged to face toward one another, a tube cap (at the top of the page), a lock-support frame below the tube cap, a post holder below the lock-support frame, and a tube floor (at the bottom of the page), (2) a releasable tube anchor including (from bottom to top) first and second retractable motion-blocker latches, a horizontal motion-control pin, an upright latch retractor, and a lift handle (to the left of the latch retractor), and (3) a lift-handle lock including an actuator button adapted for horizontal sliding movement on the lock-support frame of the post-support tube, a button spring adapted to engage and lie between the actuator button and a spring mount included in the lock-support frame, and vertical first and second handle-motion stop tabs arranged to extend downwardly from the actuator button.
Figures 10, 11, 12, 13:
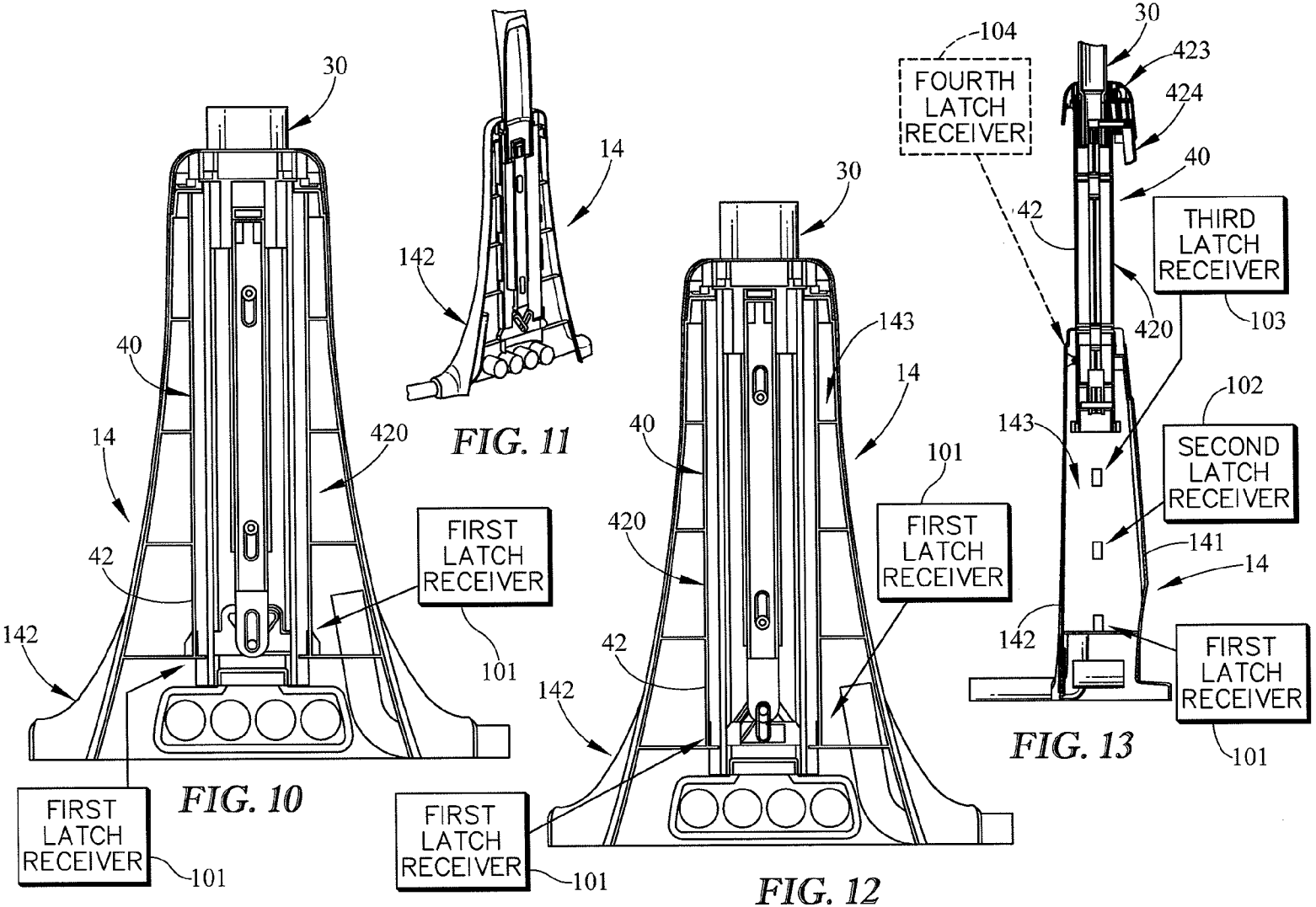
FIG. 10 is a side elevation of the interior of the first base shell shown in FIG. 6 after the post-height adjustor is mounted for up-and-down movement in the first base shell showing the first and second retractable motion-blocker latches in a spread-apart positions relative to one another to establish an anchored shape of the post-height adjustor and to extend into opposing first latch receivers formed in the first base shell to retain the movable post-support tube in a lowest position in the vertical channel formed in the stationary foundation.
FIG. 11 is a reduced-size perspective view of the components shown in FIG. 10.
FIG. 12 is a view similar to FIG. 10 showing that the latch retractor has been moved upwardly to move the first and second retractable motion-blocker latches to drawn-together positions relative to one another to establish an unanchored shape of the post-height adjustor and to free the post-support tube (and extensible post and swing) for up-and-down movement relative to the stationary foundation.
FIG. 13 is a sectional view taken along line 13-13 of FIG. 2 and showing diagrammatic representations of the first, second, and third latch receivers included in the stationary foundation and suggesting that the first and second retractable motion-blocker latches are spread apart to engage the fourth latch receivers included in the stationary foundation to retain the post-height adjustor, extensible post, swing mount, and swing in the highest elevated position shown in FIG. 3.

Releasable tube anchor 43 is coupled to post-support tube 42 to move up and down therewith in the vertical channel 143 formed in base 140 of stationary foundation 14 as suggested in FIGS. 5, 12, and 13. Releasable tube anchor 43 includes retractable first and second motion-blocker latches 431, 432, a horizontal motion-control pin 433, an upright latch retractor 434, and a lift handle 435 as suggested in FIG. 5.

Figure 7:
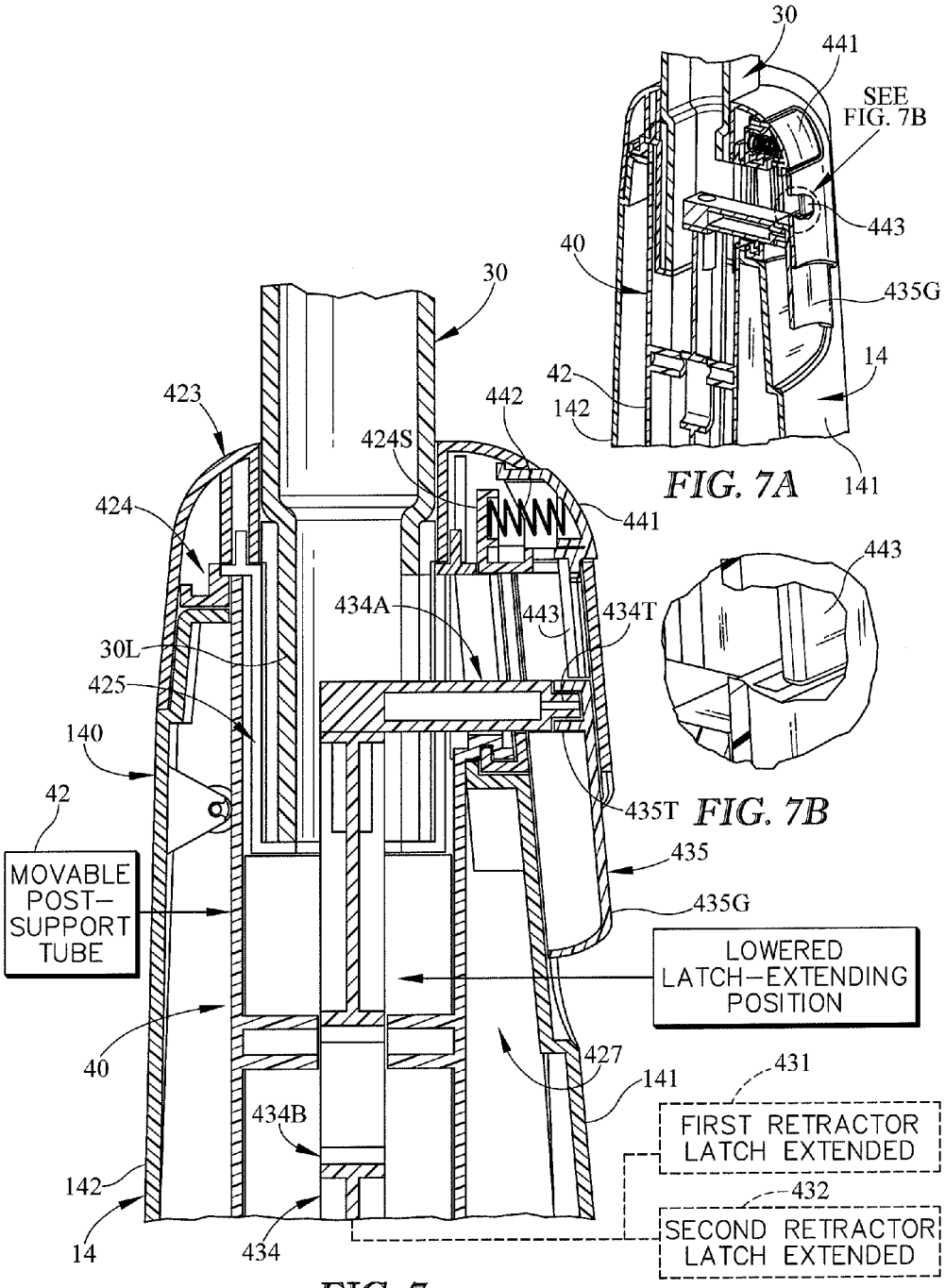
FIG. 7 is a partial sectional view taken along line 7-7 of FIG. 3B showing the latch retractor of the releasable tube anchor in a lower latch-extending position also shown in FIGS. 10 and 11 and showing that the actuator button of the lift-handle lock is spring-biased outwardly to lie in a normal retractor-blocking position to block upward movement of the latch retractor inside the movable post-support tube.

Lift handle 435 of releasable tube anchor 43 is arranged to lie outside post-support tube 42 so that it can be grasped by a caregiver while the rest of the tube anchor components lie inside post-support tube 42 as suggested in FIGS. 3B, 5, and 7. If lift handle 435 is unlocked and then raised upwardly by a caregiver, the upright latch retractor 434 that is coupled to lift handle 435 will raise the horizontal motion-control pin 433 upwardly away from floor 15 to move in the positively sloping diagonal slot 431S formed in first motion-blocker latch 431 and in the negatively sloping diagonal slot 432S formed in second motion-blocker latch 432 to cause the latches 431, 432 to retract from extended positions engaging latch receivers formed in base 140 of stationary foundation 14 as shown in FIG. 10 to retracted positions disengaging latch receivers formed in base 140 of stationary foundation 14 as shown in FIG. 12 to free the post-support tube 42 so that it can be moved up and down in adjustor-receiving vertical channel 143 formed in base 140 of stationary foundation 14. This allows a caregiver to move the post-support tube 42 from a lowest position shown in FIG. 1 to a highest position shown in FIG. 13 and thus raise the extensible post 30 that is carried on an upper portion of post-support tube 42 to change the elevation of the swing mount 20 that is coupled to an upper portion of extensible post 30 and the swing 12 that is coupled to the swing mount 20.

Figure 6:
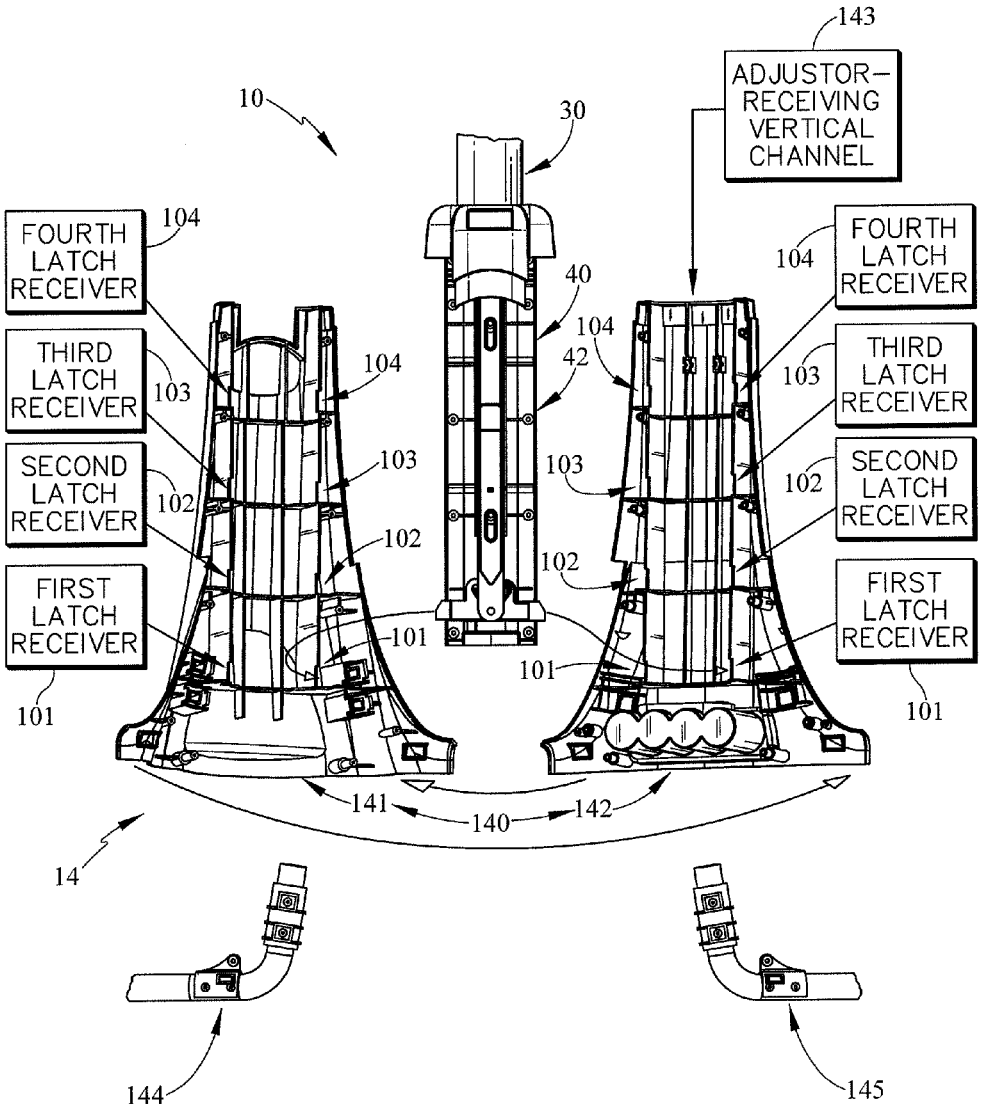
FIG. 6 is an exploded side elevation assembly view (with portions broken away) showing the post-height adjustor located between the first and second base shells, a portion of the extensible post extending upwardly from the post-height adjustor, and portions of the first and second base stabilizer legs below the base shells, and showing that each of the base shells is formed to include two sets of four latch receivers and suggesting that the first latch receivers are located near the bottom of the base shells and arranged to receive the retractable post motion-blocker latches to retain the extensible post (and the swing mount and swing) in the lowest elevated position and that the fourth latch receivers are located near the top of the base shells and arranged to retain the extensible post (and the swing mount and swing) in the highest elevated position.

Four sets of illustrative latch receivers 101-104 are formed in base 140 of stationary foundation 14 to receive the first and second motion-blocker latches 431, 432 of releasable tube anchor 43 to establish the elevation of post-height adjustor 40 and thus the elevation of extensible post 30, swing mount 20, and wing 12 relative to the floor 15 under the stationary foundation 14. First latch receivers 101 are located near the bottom of base shells 141, 42 as shown in FIG. 6 to receive motion-blocker latches 431, 432 to retain post-support tube 42 in a lowest elevated position as suggested in FIGS. 10 and 11. Fourth latch receivers are formed in base shells 141, 142 as shown in FIG. 6 to retain post-support tube 42 in a highest elevated position as suggested in FIG. 13. Second latch receivers 102 are formed in base shells 141, 142 to lie between first and fourth latch receivers 101, 104 to receive motion-blocker latches 431, 432 to establish a lower intermediate elevated position of post-support tube 42. Third latch receivers 103 are formed in base shells 141, 142 to lie between second and fourth latch receivers 102, 104 to receive motion-blocker latches 431, 432 to establish a relatively higher intermediate elevated position of post-support tube 42. As a result, post-height adjustor 40 can be operated by a caregiver to retain swing 12 in (1) the lowest elevated position shown in FIG. 1 by moving post-support tube 42 relative to stationary foundation 14 to cause motion-blocker latches 431, 432 to engage first latch receivers 101 formed in base 140; (2) the highest elevated position shown in FIG. 2 by moving post-support tube 42 relative to stationary foundation 14 to cause motion-blocker latches 431, 432 to engage fourth latch receivers 104 formed in base 140; (3) the lowest intermediate elevated position shown in FIGS. 3A and 3B by moving post-support tube 42 relative to stationary foundation 14 to cause motion-blocker latches 431, 432 to engage second latch receivers 102 formed in base 140; and (4) the highest intermediate elevated position (not shown) by moving post-support tube 42 relative to stationary foundation 14 to cause motion-blocker latches 431, 432 to engage third latch receivers 103 formed in base 140.

Post-support tube 42 of post-height adjustor 40 is sized to fit into and slide up and down in the vertical channel 143 formed between base shells 141, 142 of base 140 as suggested in FIGS. 4, 6, 12, and 13. As shown in FIG. 5, post-support tube 42 includes companion upright first and second tube shells 421, 422, a tube cap 423, a lock-support frame 424, a post holder 425, and a tube floor 426. First and second shells 421, 422 are mated to form a sleeve 420 as suggested in FIGS. 2 and 5. A top opening into sleeve 420 is covered by a closure assembly comprising tube cap 423, lock-support frame 424, and post holder 425 as suggested in FIG. 5. A bottom opening into sleeve 420 is closed by mating tube floor 426 with lower ends of each of first and second tube shells 421, 422 as suggested in FIG. 5. Once assembled, post-support tube 42 is formed to include a hollow chamber 427 sized to receive upright latch retractor 434, horizontal motion-control pin 433, and first and second motion-blocker latches 431, 432 as suggested in FIG. 5.

A lower portion 30L of extensible post 30 is sized to extend through a cap passage 423P formed in tube cap 423 and a frame passage 424P formed in lock-support frame 424 into an interior post-receiving chamber 425C formed in post holder 425 as suggested in FIGS. 5 and 7 to couple lower portion 30L of extensible post 30 to an upper portion 42U of post-support tube 42. Post holder 425 is coupled to upper ends of first and second tube shells 421, 422 to move therewith in vertical channel 143 formed in base 140 of stationary foundation 14.

Latch retractor 434 includes a vertical body 434B having a lower end formed include a pin-receiving hole 434H sized to receive motion-control pin 433 therein as shown, for example, in FIG. 5. Latch retractor 434 also includes a handle-support arm 434A cantilevered to an upper end of vertical body 434B and configured to mate with and support lift handle 435 for up-and-down movement therewith relative to sleeve 420. In an illustrative embodiment, a tab 434T included in handle-support arm 434A is arranged to extend into a tab receiver 435T formed in lift handle 435 as suggested in FIGS. 5 and 7. Lift handle 435 also includes a handle grip 435G coupled to tab receiver 435T and arranged to lie outside of hollow chamber 427 formed in post-support tube 42 as suggested in FIGS. 3B and 7.

Lift handle lock 44 includes an actuator button 441, a button spring 442, and handle-motion stop tabs 443, 444 as shown, for example, in FIG. 5. Actuator button 441 is adapted for horizontal sliding movement on lock-support frame 424 of post-support tube 42 as suggested in FIGS. 5 and 7-9. Button spring 442 is adapted to engage and lie between actuator button 441 and a spring mount 424S included in lock-support frame 424 as suggested in FIGS. 5 and 7-9. Handle-motion stop tabs 443, 444 are arranged to extend downwardly from actuator button 441 as shown best in FIG. 5.

An infant swing unit 10 in accordance with the present disclosure includes a foundation 14 adapted to set on a floor 15 and a swing 12 adapted to support an infant or other juvenile for swinging movement about horizontal swing axis 12A as suggested in FIG. 1. Infant swing unit 10 is configured to allow the height of swing 12 above the underlying floor 15 to be varied by a caregiver as suggested in FIGS. 1-3B.

Infant swing unit 10 includes a variable-height swing carrier 16 arranged to interconnect foundation 14 and swing 12 as suggested in FIG. 1. Swing carrier 16 includes an elevated swing mount 20 coupled to a pivotable swing arm of swing 12 and an extensible post 30 extending downwardly from the elevated swing mount 20 to mate with an underlying post-height adjustor 40 that is mounted for up-and-down movement in the stationary foundation 14 as suggested in FIGS. 1-3A. Post-height adjustor 40 is operable by a caregiver to adjust the height of extensible post 30 so as to change the elevation of swing 12.

Post-height adjustor 40 is configured to provide means for supporting extensible post 30 for up-and-down movement relative to stationary foundation 14 and retaining the extensible post 30 in more than one elevated position relative to the stationary foundation 14 so that the height of swing 12 above the ground 15 underlying foundation 14 can be varied by a caregiver as suggested in FIGS. 1-3B. A lower end 30L of extensible post 30 is supported on an upper end of post-height adjustor 40 as suggested in FIG. 7. Post-height adjustor 40 can be unlocked and then moved upwardly relative to the stationary foundation 14 by a caregiver to raise extensible post 30 and move swing mount 20 and swing 12 coupled to swing mount 20 to a higher elevation above floor 15. Post-height adjustor 40 also can be unlocked and then moved downwardly by the caregiver to lower extensible post 30 and move swing mount 20 and swing 12 to a lower elevation closer to the floor 15.

Post-height adjustor 40 comprises a movable post-support tube 42 coupled to a lower end 30L of extensible post 30, a releasable tube anchor 43 including a lift handle 435, and a lift handle lock 44. The movable post-support tube 42 is configured to be moved by a caregiver upwardly and downwardly in a vertical channel 143 formed in the stationary foundation 14 to change the elevation of extensible post 30, swing mount 20, and swing 12. Extensible post 30 moves upwardly and downwardly with the movable post-support tube 42 since the lower end 30L of extensible post 30 is coupled to an upper end of the movable post-support tube 42 as suggested in FIGS. 7-9.

The releasable tube anchor 43 includes a motion-blocker latch 431 that can be extended laterally outwardly from post-support tube 42 into one of several latch receivers 101-104 formed in stationary foundation 14 to retain post-support tube 42 in a fixed position relative to stationary foundation 14 so as to determine the elevation of the extensible post 30, swing mount 20, and swing 12 relative to stationary foundation 14 and underlying floor 15. To change the elevation of swing 12, the caregiver first actuates lift handle lock 44 to unlock the normally locked lift handle 435 included in the movable post-support tube 42 as suggested in FIG. 8. The caregiver can lift the lift handle 435 upwardly when the lift handle 435 is unlocked as suggested in FIG. 9 to cause a latch retractor 434 coupled to the lift handle 435 to retract the motion-blocker latch 431 laterally inwardly into the post-support tube 42 to disengage the latch receiver 101, 102, 103, or 104 formed in the stationary foundation 14 to free the post-support tube 42 and its lift handle 435 to be moved by the caregiver to a new higher or lower position in the vertical channel 143 formed in the stationary foundation 14. Lift handle lock 44 is configured normally to block lifting of lift handle 435. However, lift handle lock 44 can be operated by the caregiver to unblock lift handle 435 so that lift handle 435 can be lifted and post-support tube 42 can be moved upwardly and downwardly in vertical channel 143 formed in stationary foundation 14 to change the elevation of extensible post 30, swing mount 20, and swing 12.

A perspective view of an infant swing unit 10 provided in FIG. 1 shows that a swing 12 is adapted to support an infant for swinging motion about a horizontal swing axis 12A and that a variable-height swing carrier 16 is provided to interconnect a stationary foundation 14 and swing 12 and position swing 12 in a lowest elevated position at a lowest elevation ($E_L$) above the underlying floor 15. Swing carrier 16 includes an elevated swing mount 20 coupled to the upper end of the pivotable swing arm 18D included in child restraint 18 of swing 12, an extensible post 30 arranged for up-and-down movement in the stationary foundation 14 to raise and lower swing mount 20 and swing 12 relative to the underlying floor 15, and a caregiver-controlled post-height adjustor 40 provided in the foundation 14 and configured to support and move the extensible post 30 in upward and downward directions in foundation 14 and to retain extensible post 30 in various raised and lowered positions to allow a caregiver to vary the height of extensible post 30 so as to change the elevation of swing mount 20 and swing 12 above the underlying floor 15.

Figure 2:
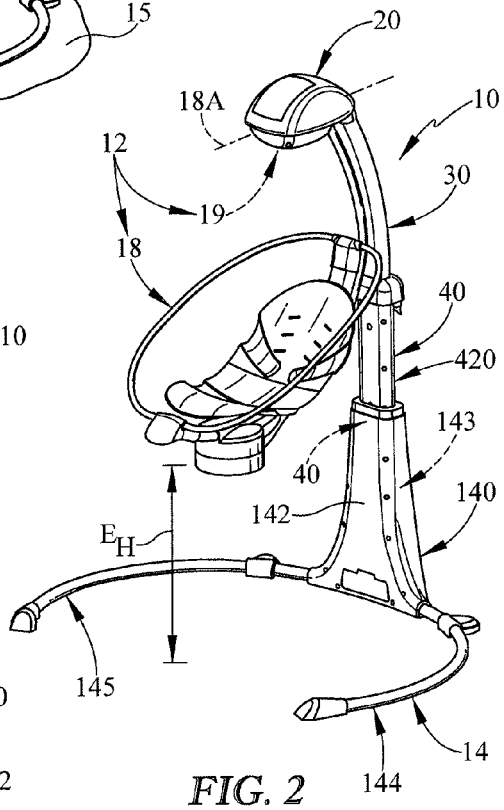
FIG. 2 is a view similar to FIG. 1 showing that the swing is positioned to lie in a highest elevated position above the underlying floor after a caregiver operated the post-height adjustor suggested in FIG. 1 to free the extensible post to move relative to the stationary foundation to extend further out of the stationary foundation (see also FIG. 13) to move the swing mount upwardly so that the swing hangs in a highest elevated position at a highest elevation ($E_H$) above the underlying floor.

Swing 12 is positioned to lie in a highest elevated position above the underlying floor 15 as suggested in FIG. 2 after a caregiver operated the post-height adjustor 40 to free the extensible post 30 to move relative to stationary foundation 14 to extend further out of stationary foundation 14 to move swing mount 20 upwardly so that swing 12 hangs in a highest elevated position at a highest elevation ($E_H$) above the underlying floor 15. Swing 12 can be positioned to lie in one of two intermediate elevated positions at a first intermediate elevation ($E_I$) above the underlying floor as shown in FIG. 3A.

Latch retractor 434 of releasable tube anchor 43 is shown in FIG. 7 in a lower latch-extending position. Actuator button 441 of lift-handle lock 44 is spring-biased outwardly to lie in a normal retractor-blocking position to block upward movement of latch retractor 434 inside movable post-support tube 42. The laterally spaced-apart handle-motion stop tabs 443, 444 that extend downwardly from spring-biased actuator button 441 as shown in FIG. 7B to engage the underlying laterally spaced-apart tab flanges included in lift handle 435 to lock lift handle 435 and thereby block upward movement of latch retractor 434 relative to the movable post-support tube 42.

Figures 8, 8A, 8B:
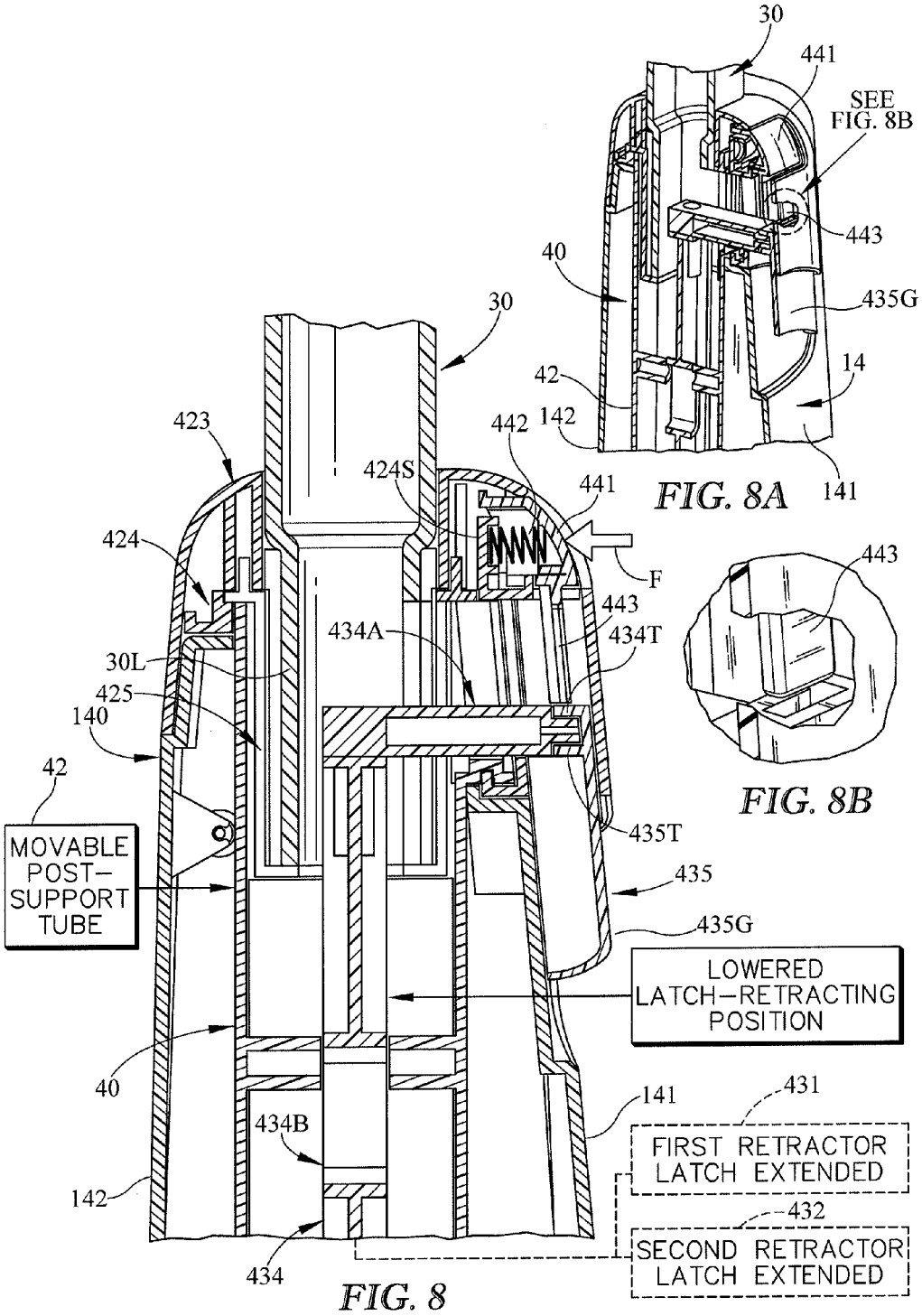
FIG. 8 is a view similar to FIG. 7 showing that a caregiver has applied a force (F) to move the spring-biased actuator button included in the lift-handle lock to the left to unlock the lift handle so that the latch retractor can be moved upwardly in the relatively stationary movable post-support tube to disengage the first and second retractable post motion-blocker latches from the latch receivers formed in the base of the stationary foundation as suggested in FIG. 12.
FIG. 8A is a perspective view of the components shown in FIG. 8.
FIG. 8B is an enlarged view of the circled region of FIG. 8A (with a portion of the tube cap broken away) to show disengagement of the laterally spaced-apart handle-motion stop tabs that extend downwardly from the spring-biased actuator button from the underlying spaced-apart tab flanges included in the lift handle to allow upward movement of the latch retractor relative to the movable post-support tube toward the raised latch-retracting position shown in FIG. 9.

A caregiver applies a force (F) as suggested in FIG. 8 to move the spring-biased actuator button 441 included in lift-handle lock 44 to the left to unlock lift handle 435 so that latch retractor 434 can be moved upwardly in the relatively stationary movable post-support tube 42 to disengage the first and second retractable post motion-blocker latches 431, 432 from the latch receivers 101, 102, 103, or 104 formed in the base of the stationary foundation 14 as suggested in FIG. 12. The laterally spaced-apart handle-motion stop tabs 443, 444 that extend downwardly from the spring-biased actuator button 441 are disengaged from the underlying spaced-apart tab flanges included in the lift handle 435 as shown in FIG. 8B to allow upward movement of latch retractor 434 relative to movable post-support tube 42 toward the raised latch-retracting position shown in FIG. 9.

As suggested in FIG. 9, a caregiver has applied a lifting force to the unlocked lift handle 435 shown in FIG. 8 and then lifted the latch retractor 434 to the raised latch-retracting position shown in FIG. 12 so that the post-height adjustor 40, extensible post 30, swing mount 20, and swing 12 can be moved as a unit up and down relative to the stationary foundation 14 to change the elevation of the swing 12 above the underlying floor 15. FIG. 9B is an enlarged view of the circled region of FIG. 9A (with a portion of the tube cap broken away) to show that the laterally spaced-apart handle-motion stop tabs extend downwardly through to straddle a horizontally extending handle mount coupled to the top of the latch retractor 434.

The interior of the first base shell is shown in FIG. 10 after the post-height adjustor 40 is mounted for up-and-down movement in the first base shell 441. First and second retractable motion-blocker latches 431, 432 are shown in a spread-apart positions relative to one another to establish an anchored shape of the post-height adjustor 40 and to extend into opposing first latch receivers 101 formed in the first base shell 441 to retain the movable post-support tube 42 in a lowest position in the vertical channel 143 formed in the stationary foundation 14. Latch retractor 430 has been moved upwardly as suggested in FIG. 12 to move the first and second retractable motion-blocker latches 431, 43 to drawn-together positions relative to one another to establish an unanchored shape of the post-height adjustor 40 and to free the post-support tube 42 (and extensible post 30 and swing 12) for up-and-down movement relative to the stationary foundation 14.

FIG. 13 is a sectional view taken along line 13-13 of FIG. 2 and showing diagrammatic representations of the first, second, and third latch receivers 101, 102, 103 included in the stationary foundation 14. The first and second retractable motion-blocker latches 431, 432 are spread apart to engage the fourth latch receivers 104 included in the stationary foundation 14 to retain the post-height adjustor 40, extensible post 30, swing mount 20, and swing 12 in the highest elevated position shown in FIG. 3.

The invention claimed is:

1. A juvenile swing unit comprising a foundation adapted to set on a floor, a swing adapted to support a child, and a variable-height swing carrier arranged to interconnect the foundation and the swing, the variable-height swing carrier including an extensible post, an elevated swing mount coupled to an upper portion of the extensible post to move therewith and configured to support the swing for up-and-down movement therewith relative to the foundation and for swinging movement about a horizontal swing axis, and a post-height adjustor including a lift handle connected to an upright latch retractor, the post-height adjustor mounted for up-and-down movement in the foundation and configured to provide means for supporting the extensible post for up-and-down movement relative to the foundation to change the elevation of the elevated swing mount and retaining the extensible post in more than one elevated position relative to the foundation so that height of the swing supported by the elevated swing mount above the floor underlying the foundation can be varied by a caregiver.

2. The juvenile swing unit of claim 1, wherein the post-height adjustor is coupled to a lower portion of the extensible post to lie in spaced-apart relation to and below the elevated swing mount.

3. A juvenile swing unit comprising a foundation adapted to set on a floor, a swing adapted to support a child, and a variable-height swing carrier arranged to interconnect the foundation and the swing, the variable-height swing carrier including an extensible post, an elevated swing mount coupled to an upper portion of the extensible post to move therewith and configured to support the swing for up-and-down movement therewith relative to the foundation and for swinging movement about a horizontal swing axis, and a post-height adjustor mounted for up-and-down movement in the foundation and configured to provide means for supporting the extensible post for up-and-down movement relative to the foundation to change the elevation of the elevated swing mount and retaining the extensible post in more than one elevated position relative to the foundation so that height of the swing supported by the elevated swing mount above the floor underlying the foundation can be varied by a caregiver, wherein the post-height adjustor includes a post-support tube and a releasable tube anchor including a lift handle, the post-support tube is coupled to a lower end of the extensible post and mounted for up- and-down movement in a vertical channel formed in the foundation, and the releasable tube anchor is mounted for movement relative to the post-support tube and to the foundation to change from an anchored shape engaging a latch receiver formed in the foundation to block up-and-down movement of the post-support tube relative to the foundation to an unanchored shape disengaging the latch receiver formed in the foundation to allow up-and-down movement of the post-support tube relative to the foundation to vary the elevation of the elevated swing mount and swing relative to the foundation.

4. The juvenile swing unit of claim 3, wherein the releasable tube anchor includes a motion-blocker latch that can be extended laterally outwardly from the post-support tube into one of several latch receivers formed in the foundation to retain the post-support tube in a fixed position relative to the foundation so as to determine the elevation of the extensible post, swing mount, and swing relative to the foundation and the underlying floor.

5. The juvenile swing unit of claim 3, wherein the releasable tube anchor includes an upright latch retractor mounted for up-and-down movement relative to the post-support tube, a retractable first motion-blocker latch mounted for movement relative to the upright latch retractor and configured to engage the latch receiver formed in the foundation when the releasable tube anchor assumes the anchored shape, and a horizontal motion-control pin, the retractable first motion-blocker latch is formed to include a sloping slot, the horizontal motion-control pin is coupled to the upright latch retractor for up-and-down movement therewith and is arranged to extend into and move in the sloping slot formed in the retractable first motion-blocker latch, and the horizontal motion-control pin is raised upwardly away from the floor underlying the foundation to move in the sloping slot formed in the retractable first motion-blocker latch to cause the retractable first motion-blocker latch to retract from an extended position engaging the latch receiver formed in the foundation to a retracted position disengaging the latch receiver formed in the foundation to free the post-support tube to be moved up and down in the vertical channel formed in the foundation to allow a caregiver to move the extensible post that is carried on the post-support tube to change the elevation of the swing mount and the swing that is coupled to the swing mount relative to the foundation.

6. The juvenile swing unit of claim 5, wherein the lift handle is coupled to the upright latch retractor to move therewith relative to the post-support tube, the lift handle is arranged to extend through and move up and down in an opening formed in the post-support tube to provide a handgrip portion arranged to lie outside of the post-support tube while the upright latch retractor remains inside the post-support tube to provide means for raising the upright latch retractor inside and relative to the post-support tube to raise the horizontal motion-control pin upwardly away from the floor underlying the foundation in the sloping slot to cause the retractable first motion-blocker latch to move from the extended position to the retracted position.

7. The juvenile swing unit of claim 6, wherein the releasable tube anchor further includes lift-handle lock means for selectively locking the lift handle in a stationary position relative to the post-support tube to block up-and-down movement of the upright latch retractor relative to the post-support tube.

8. The juvenile swing unit of claim 5, wherein the sloping slot formed in the retractable first motion-blocker latch has a positive slope, the releasable tube anchor further includes a retractable second motion-blocker latch formed to include a negatively sloping slot arrange to communicate with the positively sloping slot formed in the retractable first motion-blocker latch, the horizontal motion-control pin extends through and moves in both of the positively and negatively sloping slots simultaneously, and upward movement of the upright latch retractor relative to the foundation and away from the floor underlying the foundation raises the horizontal motion-control pin upwardly away from the floor to move simultaneously in the positively sloping slot formed in the retractable first motion-blocker latch and in the negatively sloping slot formed in the retractable second motion-blocker latch to cause the retractable first and second motion-blocker latches to retract simultaneously from extended positions engaging latch receivers formed in the foundation to retracted positions disengaging the latch receivers formed in the foundation to free the post-support tube so that it can be moved up and down in the vertical channel formed in the foundation.

9. The juvenile swing unit of claim 8, wherein each of the sloping slots has a diagonal shape and the positively sloping and negatively sloping slots intersect to form a pin-receiving space receiving the horizontal motion-control pin therein and cooperate to form an X-shaped channel when the horizontal motion-control pin is midway between opposite ends of each slot.

10. A juvenile swing unit comprising a foundation adapted to set on a floor, a swing adapted to support a child, and a variable-height swing carrier arranged to interconnect the foundation and the swing, the variable-height swing carrier including an extensible post, an elevated swing mount coupled to an upper portion of the extensible post to move therewith and configured to support the swing for up-and-down movement therewith relative to the foundation and for swinging movement about a horizontal swing axis, and a post-height adjustor mounted for up-and-down movement in the foundation and configured to provide means for supporting the extensible post for up-and-down movement relative to the foundation to change the elevation of the elevated swing mount and retaining the extensible post in more than one elevated position relative to the foundation so that height of the swing supported by the elevated swing mount above the floor underlying the foundation can be varied by a caregiver, wherein the post-height adjustor includes a post-support tube coupled to the extensible post mounted for up-and-down movement relative to the foundation and a releasable tube anchor associated with the extensible post and the releasable tube anchor comprises a pair of retractable post motion-blocker latches and a latch retractor linked to the post motion-blocker latches to move the post motion-blocker latches relative to the post-support tube and to the foundation from extended positions wherein the latches engage companion latch receivers formed in the foundation to block up-and-down movement of the post-height adjustor and the extensible post relative to the foundation to retracted positions wherein the post-support tube and the extensible post are free to be moved by a caregiver in up- and-down directions relative to the foundation to change the elevation of the swing mount and the swing relative to the foundation and the floor underlying the foundation.

11. The juvenile swing unit of claim 10, wherein the foundation includes a base formed to include an adjustor-receiving vertical channel, a first base stabilizer leg coupled to one side of the base, and a second base stabilizer leg coupled to another side of the base to locate the base between the first and second stabilizer legs, and the post-height adjustor is mounted for up-and-down movement in the adjustor-receiving vertical channel, and the latch receivers are formed in the base.

12. The juvenile swing unit of claim 11, wherein the base includes upright first and second base shells mated to one another to form the adjustor-receiving vertical channel therebetween, the first base shell is formed to include latch receivers arranged to receive a first of the post motion-blocker latches therein, and the second base shell is formed to include latch receivers arranged to receive a second of the post motion-blocker latches therein.

13. The juvenile swing unit of claim 12, wherein each of the base shells is formed to include at least two latch receivers, a first of the latch receivers is located near a bottom of each of the base shells and is arranged to receive a post motion-blocker latch to retain the extensible post, swing mount, and swing in a lowest elevated position relative to the foundation, and a second of the latch receivers is located near a top of each of the base shells and is arranged to receive a post motion-blocker latch to retain the extensible post, swing mount, and swing in a highest elevated position relative to the foundation.

* * * * *